US012397952B2

(12) United States Patent
Jeong

(10) Patent No.: US 12,397,952 B2
(45) Date of Patent: Aug. 26, 2025

(54) DEVICE AND METHOD FOR OPENING PLASTIC BAG

(71) Applicant: LG ENERGY SOLUTION, LTD., Seoul (KR)

(72) Inventor: Byeong Oh Jeong, Daejeon (KR)

(73) Assignee: LG ENERGY SOLUTION, LTD., Seoul (KR)

( * ) Notice: Subject to any disclaimer, the term of this patent is extended or adjusted under 35 U.S.C. 154(b) by 0 days.

(21) Appl. No.: 18/563,313

(22) PCT Filed: Nov. 3, 2022

(86) PCT No.: PCT/KR2022/017132
§ 371 (c)(1),
(2) Date: Nov. 21, 2023

(87) PCT Pub. No.: WO2023/113229
PCT Pub. Date: Jun. 22, 2023

(65) Prior Publication Data

US 2024/0270424 A1 Aug. 15, 2024

(30) Foreign Application Priority Data

Dec. 16, 2021 (KR) ..... 10-2021-0181100

(51) Int. Cl.
*B65B 43/28* (2006.01)
*B65B 43/30* (2006.01)
*B65B 43/36* (2006.01)

(52) U.S. Cl.
CPC ..... *B65B 43/28* (2013.01); *B65B 43/30* (2013.01); *B65B 43/36* (2013.01)

(58) Field of Classification Search
CPC ..... B65B 43/28; B65B 43/18; B65B 43/34; B65B 43/30; B65B 43/36; B31B 70/003
See application file for complete search history.

(56) References Cited

U.S. PATENT DOCUMENTS

| | | | | |
|---|---|---|---|---|
| 10,836,525 | B1 | 11/2020 | Alspaugh | |
| 2006/0207225 | A1 | 9/2006 | Fukuda | |
| 2008/0110132 | A1 * | 5/2008 | Yan Ruz | B65B 43/30 53/385.1 |

FOREIGN PATENT DOCUMENTS

| | | | | |
|---|---|---|---|---|
| DE | 2527693 | A1 * | 1/1977 | B65B 43/36 |
| JP | 57-110010 | U | 7/1982 | |
| JP | 59-1928 | Y2 | 1/1984 | |
| JP | 64-20409 | U | 2/1989 | |
| JP | 5-254517 | A | 10/1993 | |

(Continued)

OTHER PUBLICATIONS

Translation of DE 2527693 A1 (Year: 1977).*

(Continued)

*Primary Examiner* — Thomas M Wittenschlaeger
(74) *Attorney, Agent, or Firm* — Birch, Stewart, Kolasch & Birch, LLP

(57) ABSTRACT

A plastic bag opening device, which opens an inlet of a plastic bag having a pocket shape, includes an elevating member that lifts the plastic bag in a state in which a first surface of the plastic bag is adhered; and an air blower that injects air toward the inlet of the plastic bag adhered to the elevating member so that the inlet of the plastic bag is opened. Accordingly, the inlet of the plastic bag may be completely opened.

10 Claims, 10 Drawing Sheets

(56) References Cited

FOREIGN PATENT DOCUMENTS

| | | | |
|---|---|---|---|
| JP | 8-156917 | A | 6/1996 |
| JP | 9-226724 | A | 9/1997 |
| JP | 4918152 | B2 | 4/2012 |
| JP | 2013-142001 | A | 7/2013 |
| JP | 2018-135119 | A | 8/2018 |
| JP | 2020-172310 | A | 10/2020 |
| KR | 10-0391971 | B1 | 7/2003 |
| KR | 10-0438122 | B1 | 7/2004 |
| KR | 10-0460965 | B1 | 12/2004 |
| KR | 20-0432422 | Y1 | 12/2006 |
| KR | 10-2012-0026315 | A | 3/2012 |
| KR | 10-1242769 | B1 | 3/2013 |
| KR | 10-1281542 | B1 | 7/2013 |
| KR | 10-1446670 | B1 | 10/2014 |
| KR | 10-2018-0005372 | A | 1/2018 |
| KR | 10-2018-0024372 | A | 3/2018 |
| KR | 10-1841425 | B1 | 3/2018 |
| KR | 10-2019-0103842 | A | 9/2019 |
| KR | 10-2092123 | B1 | 3/2020 |

OTHER PUBLICATIONS

Translation of JP 08156917 (Year: 1994).*
Partial European Search Report for European Application No. 22907700.3, dated Sep. 18, 2024.
International Search Report issued in PCT/KR2022/017132 (PCT/ISA/210), mailed on Feb. 15, 2023.

* cited by examiner

DEVICE AND METHOD FOR OPENING PLASTIC BAG

TECHNICAL FIELD

Cross-Reference to Related Applications

The present application claims the benefit of the priority of Korean Patent Application No. 10-2021-0181100, filed on Dec. 16, 2021, which is hereby incorporated by reference in its entirety.

Technical Field

The present disclosure relates to a device and method for opening a plastic bag, which is capable of automatically opening an inlet of the plastic bag.

BACKGROUND ART

In general, products such as foods, medicines and articles, are packed and distributed in packaging bags in the form of a bag, and a synthetic resin is generally used as a material of the packaging bags.

For example, the packaging bags may be provided as plastic bags in the form of an envelope, and the plastic bags each have a structure in which surfaces other than one surface are sealed. That is, the non-sealed one surface of the packaging bag serves as an inlet for accommodating the products.

As the industry develops, a plastic bag opening device for accommodating many products in plastic bags in a short time is developed. The plastic bag opening device includes first and second adherence pads that adhere to two opposite surfaces of the plastic bag, respectively, and a movable member that moves the first and second adherence pads in directions that are away from each other, to open the inlet of the plastic bag.

However, there is a limit to how the plastic bag opening device according to the related art completely opens the inlet of the plastic bag solely by the first and second adherence pads. That is, the inlet of the plastic bag is difficult to open because of frictional force and static electricity. Accordingly, capacity utilization may be reduced and packaging failure may occur because of a plastic bag opening error.

DISCLOSURE OF THE INVENTION

Technical Problem

An object of the present invention for solving the above problems is to provide a device for opening a plastic bag, which includes an air blower to more easily open an inlet of the plastic bag, and particularly, to completely open the inlet of the plastic bag and accordingly, may increase capacity utilization and prevent an occurrence of defective packaging, and a method for opening a plastic bag using the device.

Technical Solution

An object of the present invention for solving the above problems is to provide a plastic bag opening device that opens an inlet of a plastic bag having a pocket shape. The plastic bag opening device may include: a lifter that lifts the plastic bag in a state in which a first surface of the plastic bag is adhered; and an air blower that injects air toward the inlet of the plastic bag adhered to the lifter so that the inlet of the plastic bag is opened.

The lifter may include an adherence pad, which adheres to the first surface of the plastic bag, and an elevating part that causes the adherence pad to ascend so as to lift the plastic bag adhered to the adherence pad up to an imaginary horizontal line at which the air blower is disposed.

The air blower may include an injection nozzle, which injects the air toward the inlet of the plastic bag so that the inlet of the plastic bag is opened, the injection nozzle may have an air injection opening inclinable downward at a set angle with respect to the imaginary horizontal line; and a frame to which the injection nozzle is coupled.

The set angle may be set to 3° to 10°.

The injection nozzle may be coupled to the frame so that an angle of the injection nozzle with respect to the frame is adjustable up and down or left and right.

The plastic bag opening device may further include a rotator that rotates the lifter so that the inlet of the plastic bag adhered to the lifter faces upward.

The plastic bag opening device may further include a pair of fingers that are inserted into the inlet of the plastic bag adhered to the lifter to pull and expand the inlet of the plastic bag in opposite directions.

The plastic bag opening device may further include a movable member that moves the lifter away from the pair of fingers such that the inlet of the plastic bag is expanded between the pair of fingers and the lifter.

The present invention relates to a plastic bag opening method that opens an inlet of a plastic bag having a pocket shape. The plastic bag opening method may include: an elevating process of adhering a first surface of the plastic bag to a lifter and then lifting the plastic bag using the lifter; and an opening process of opening the inlet of the plastic bag using an air blower to inject air toward the inlet of the plastic bag adhered to the lifter so that the air injected from the air blower flows into the plastic bag through the inlet.

In the elevating process, the lifter may lift the plastic bag up to an imaginary horizontal line at which the air blower is disposed. In the opening process, the air blower may inject the air toward the inlet of the plastic bag so that the air is injected downward at a set angle with respect to the imaginary horizontal line.

The set angle may be set to 3° to 10°.

The plastic bag opening method may include, after the opening process, a rotating process of rotating the lifter using a rotator so that the inlet of the plastic bag adhered to the lifter is disposed to face upward.

The plastic bag opening method may include, after the rotation process, a primary expanding process of pulling and expanding the inlet of the plastic bag in opposite directions by inserting a pair of fingers into the inlet of the plastic bag adhered to the lifter and moving the pair of fingers in directions that are away from each other.

The plastic bag opening method may include, after the primary expanding process, a secondary expanding process of expanding the inlet of the plastic bag between the pair of fingers and the lifter using a movable member to move the lifter away from the pair of fingers.

Advantageous Effects

The plastic bag opening device according to the present invention may include the air blower to inject the air into the inlet of the plastic bag and completely open the inlet of the plastic bag. Accordingly, the capacity utilization may increase, and the occurrence of the defective packaging may be prevented.

MODE FOR CARRYING OUT THE INVENTION

Figure 1:
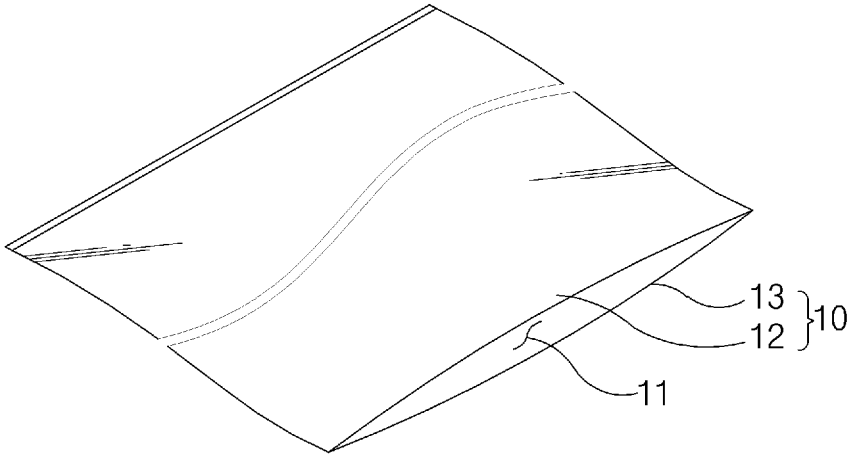
FIG. 1 is a perspective view illustrating a plastic bag according to the present invention.

Hereinafter, embodiments of the present invention will be described in detail with reference to the accompanying drawings to enable those skilled in the art to which the present invention pertains to easily carry out the present invention. The present invention may, however, be embodied in different forms and should not be construed as limited by the embodiments set forth herein. The parts unrelated to the description will be ruled out in the drawings in order to clearly describe the present invention. Like reference numerals refer to like elements throughout the whole specification.

Referring to FIG. 1, a plastic bag 10 has a structure in the form of a pocket having an end in which an inlet 11 is formed. The plastic bag 10 having such a structure is kept in a state in which the plastic bag 10 is pressed flat so that the first surface 12 and a second surface 13 are in close contact with each other. When using the plastic bag 10, the inlet 11 thereof is opened to store or pack products, etc.

However, there is a problem that the plastic bag 10 is not easily opened because of frictional force or static electricity occurring between the first surface 12 and the second surface 13.

A plastic bag opening device 1 according to a first embodiment of the present invention may automatically open the inlet 11 of the plastic bag 10, and particularly, completely open the inlet of the plastic bag. Accordingly, efficiency of accommodating articles may be improved.

Hereinafter, the plastic bag opening device according to the first embodiment of the present invention will be described in detail with reference to the drawings.

[Plastic Bag Opening Device According to First Embodiment of Present Invention]

Figure 2:
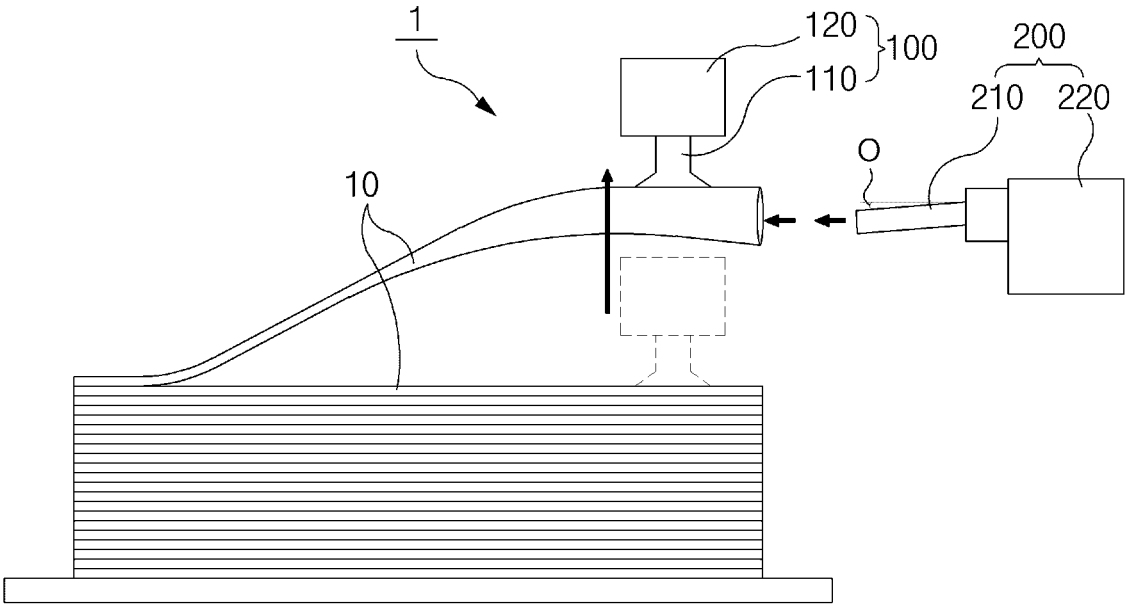
FIG. 2 is a side view illustrating a plastic bag opening device according to a first embodiment of the present invention.
Figure 3:
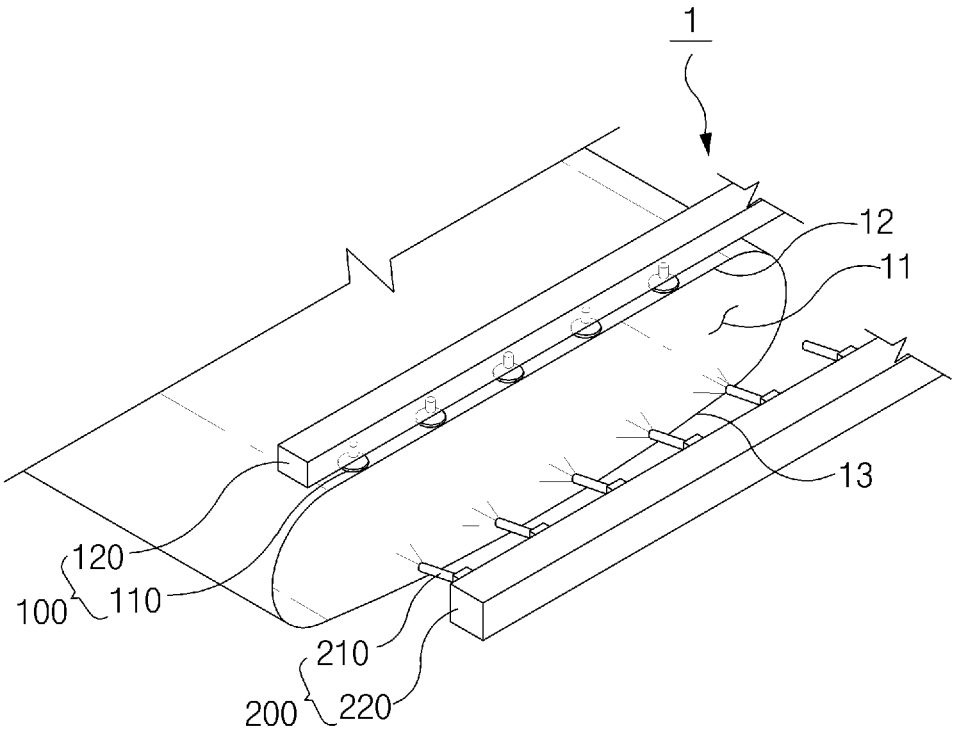
FIG. 3 is a perspective view illustrating an air blower of the plastic bag opening device according to the first embodiment of the present invention.

As illustrated in FIGS. 1 to 3, the plastic bag opening device 1 according to the first embodiment of the present invention has a structure that opens the inlet 11 of the plastic bag 10 having a pocket shape. That is, the plastic bag opening device 1 according to the first embodiment of the present invention includes an elevating member 100, which lifts the plastic bag 10 in a state in which a first surface 12 (a top surface of the plastic bag in FIG. 1) of the plastic bag 10 is adhered, and an air blower 200 which injects air toward the inlet 11 of the plastic bag 10 adhered to the elevating member 100 so that the inlet 11 of the plastic bag 10 is opened to be widened.

Elevating Member

The elevating member 100 is intended to lift the plastic bag 10.

That is, as illustrated in FIG. 2, the elevating member 100 includes an adherence pad 110, which adheres the first surface 12 of the plastic bag 10, and an elevating part 120 which allows the adherence pad 110 to ascend and lifts the plastic bag 10 adhered to the adherence pad 110 up to a horizontal line (O) at which the air blower 200 is disposed.

Here, the adherence pad 110 may be provided in plurality so as to lift the entire first surface 12 provided at a side of the inlet 11 of the plastic bag 10, and preferably, five or more adherence pads 110 may be provided.

In particular, the adherence pad 110 may have a structure in which an air suction force is used to adhere to the first surface 12 of the plastic bag 10. The elevating part 120 may be provided as a hydraulic cylinder or pneumatic cylinder that allows the adherence pad 110 to ascend or return to an initial position.

The elevating member 100 having the structure as described above may stably adhere to the first surface 12 of the plastic bag 10 and effectively lift the adhered plastic bag 10.

Air Blower

The air blower 200 is intended to open the inlet of the plastic bag.

That is, as illustrated in FIG. 3, the air blower 200 includes an injection nozzle 210, which injects the air toward the inlet 11 of the plastic bag 10 so that the inlet 11 of the plastic bag 10 is opened to be widened, and a frame 220 to which the injection nozzle 210 is coupled.

Here, the frame 220 is formed to extend in a direction corresponding to the inlet 11 of the plastic bag 10 (a front and rear direction in FIG. 1), and the injection nozzle 210 is provided in plurality at set intervals on one surface of the frame 220, which faces the plastic bag 10.

Here, the injection nozzle 210 may be provided to face the inlet 11 of the plastic bag 10 so that an air injection opening through which the air is injected is inclined downward at a set angle $\alpha$ with respect to the horizontal line (O). The air injected from the injection nozzle 210 may be injected toward the second surface 13 rather than the first surface 12 of the plastic bag 10. Accordingly, the second surface 13 of the plastic bag 10, which adheres to the first surface 12 by static electricity, etc., may be easily separated to open the inlet 11 of the plastic bag 10.

Here, the set angle $\alpha$ may be set to 3° to 10°, and preferably, may be provided as 5° to 8°. When an injection angle of the injection nozzle 210 is 3° or less, there is no significant difference compared to the case of injecting toward the horizontal line. When the injection angle is 10° or greater, the air may be injected outside the inlet 11, and thus the efficiency may be reduced.

In an operation state of the plastic bag opening device 1 according to the first embodiment of the present invention having the structure as described above, the elevating member 100 lifts the first surface 12 of the plastic bag 10 in the adhered state. Here, the second surface (a bottom surface of the plastic bag in FIG. 1) of the plastic bag 10 may have a portion adhering to the first surface by static electricity. The entirety of the second surface 13 may also adhere to the first surface, and the entirety of the second surface 13 may also be separated from the first surface due to the load.

Then, the air blower 200 is used to inject the air toward the inlet 11 of the plastic bag 10. The air injected by the air blower 200 may flow into the inlet 11 to open the inlet 11, and part of the air having flowed into the plastic bag 10 may be discharged through the inlet 11 to reopen the inlet 11.

Thus, as the plastic bag opening device 1 according to the first embodiment of the present invention includes the elevating member 100 and the air blower 200, the inlet 11 of the plastic bag 10 may be opened to be completely widened.

Rotating Member

The plastic bag opening device 1 according to the first embodiment of the present invention may further include a rotating member 400 that rotates the elevating member 100 so that the inlet 11 of the plastic bag 10 faces upward.

Figure 4:
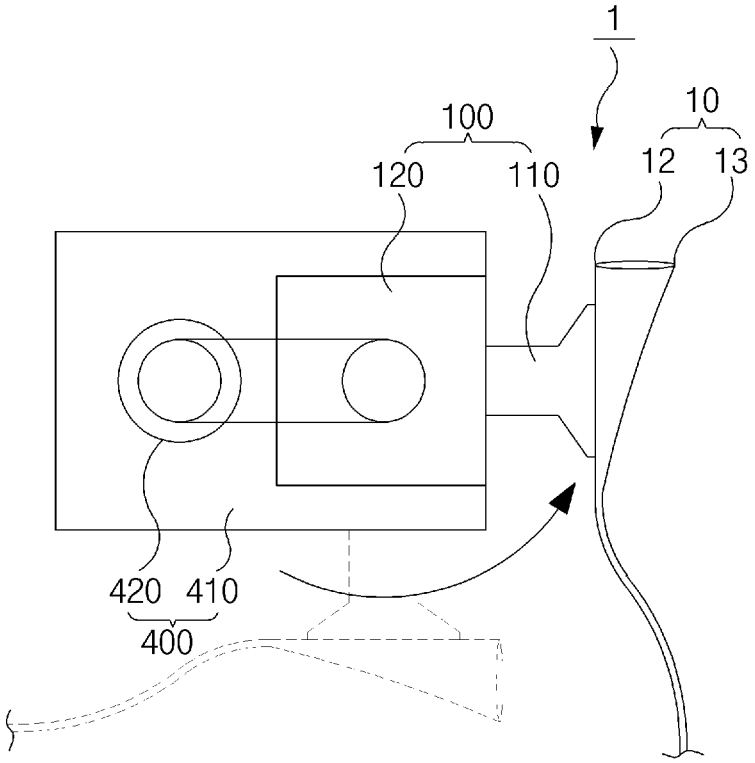
FIG. 4 is a side view illustrating a rotating member of the plastic bag opening device according to the first embodiment of the present invention.

That is, as the rotating member 400 allows the inlet 11 of the plastic bag 10 to be disposed to face upward as illustrated in FIG. 4, a product may be more easily introduced into the plastic bag 10.

In one example, the rotating member 400 includes a rotating body 410, to which the elevating member 100 is rotatably coupled, and a rotating part 420 which rotates the elevating member 100 coupled to the rotating body 310 so that the inlet 11 of the plastic bag 10 adhered to the elevating member 100 is disposed to face upward. The rotating part 420 may be a driving motor.

Finger Member

The plastic bag opening device 1 according to the first embodiment of the present invention may further include a finger member 300 that pulls the inlet 11 of the plastic bag 10 to primarily expand the inlet 11 of the plastic bag 10 in two opposite directions.

Figure 5:
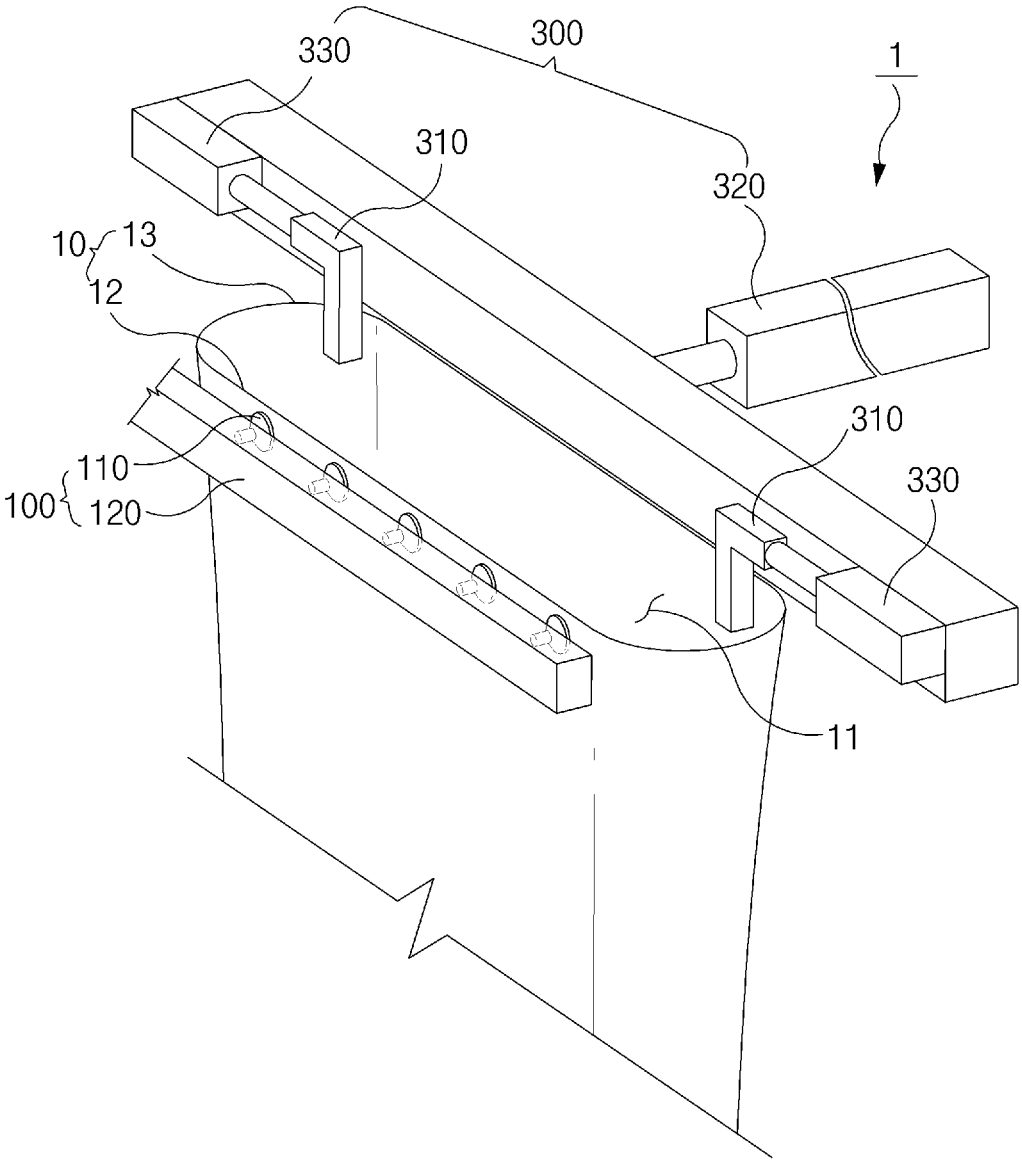
FIG. 5 is a perspective illustrating a finger member of the plastic bag opening device according to the first embodiment of the present invention.
Figure 6:
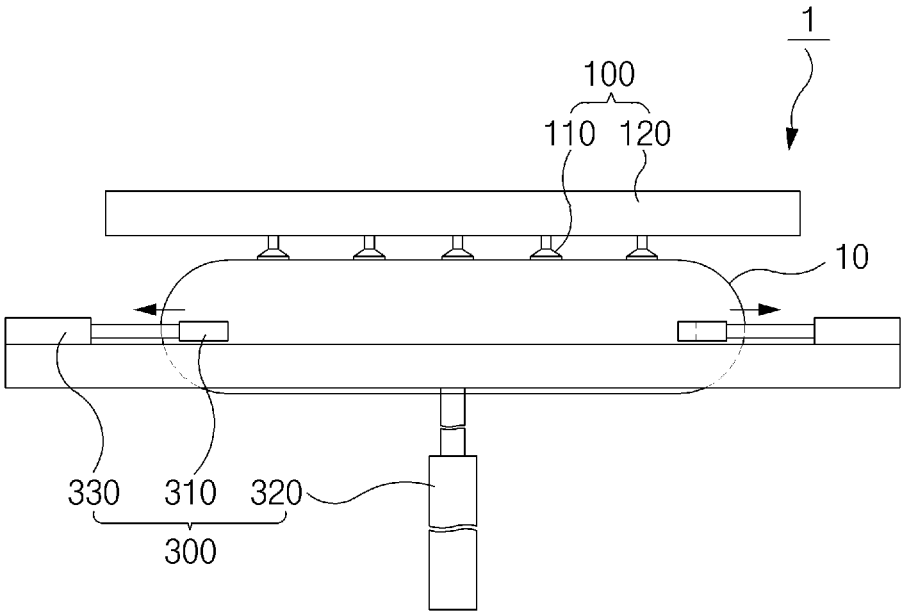
FIG. 6 is a plan view illustrating an operation state of a finger member of the plastic bag opening device according to the first embodiment of the present invention.

That is, as illustrated in FIGS. 5 and 6, the finger member 300 includes a pair of fingers 310, and the pair of fingers 310 pulls the inlet 11 of the plastic bag 10 adhered to the elevating member 100 in the two opposite directions while moving in directions that are away from each other, in a state inserted into the inlet 11 of the plastic bag 10.

In one example, the finger member 300 includes the pair of fingers 310, which pulls the inlet 11 of the plastic bag 10 adhered to the elevating member 100 in the two opposite directions while moving in the directions that are away from each other, in the state inserted into the inlet 11 of the plastic bag 10, a first driving part 320, which allows the pair of fingers 310 to descend toward the plastic bag 10 so that the pair of fingers 310 are inserted into the inlet 11 of the plastic bag 10, and a second driving part 330 which allows the pair of fingers 310 to move in the directions that are away from each other.

The finger member 300 having such a structure may expand the inlet 11 of the plastic bag 10 in the two opposite directions, and may also prevent the inlet 11 of the plastic bag 10 from sagging.

Movable Member

The plastic bag opening device 1 according to the first embodiment of the present invention may further include a movable member 500 for secondarily expanding the inlet 11 of the plastic bag 10.

Figure 7:
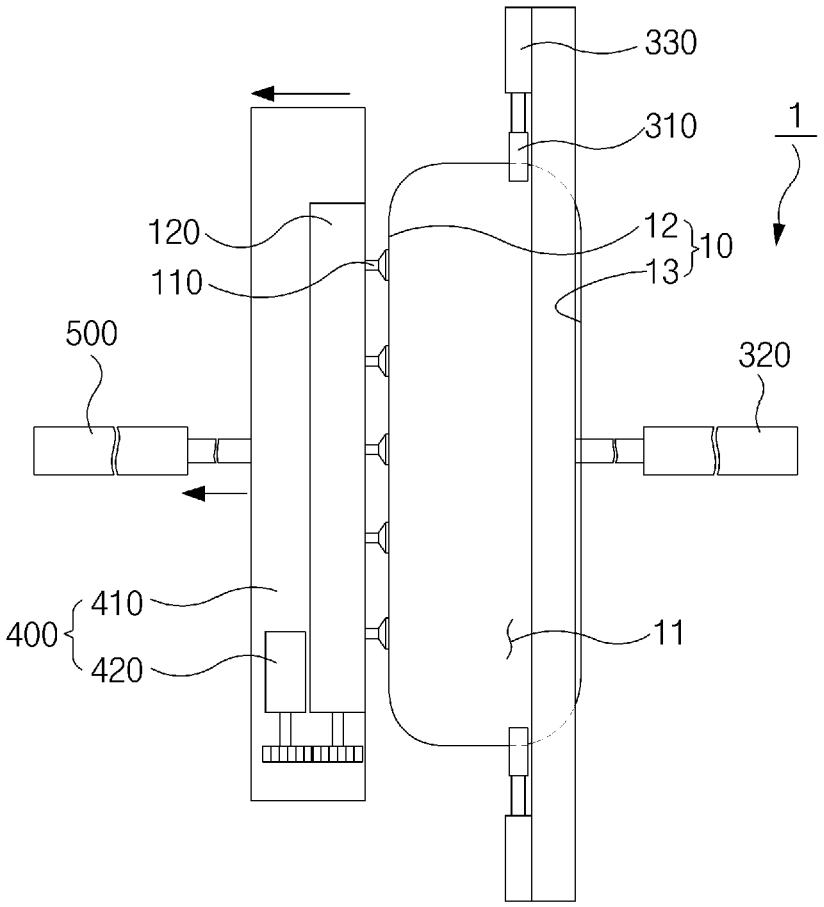
FIG. 7 is a plan view illustrating a movable member of the plastic bag opening device according to the first embodiment of the present invention.

That is, as illustrated in FIG. 7, the movable member 500 moves the elevating member 100 to be far away from the finger member 300 so that the inlet 11 of the plastic bag 10 is secondarily expanded by an area between the finger member 300 and the elevating member 100. In other words, the first surface 12 of the plastic bag is adhered to the elevating member 100, and the second surface 13 of the plastic bag 10 is supported by the finger member 400. Thus, when the movable member moves the elevating member 100, the inlet 11 of the plastic bag 10 may be expanded while the first surface 12 of the plastic bag 10 moves together with the elevating member 100.

Hereinafter, an opening method using the plastic bag opening device according to the first embodiment of the present invention will be described.

[Plastic Bag Opening Method According to First Embodiment of Present Invention]

Figure 8:
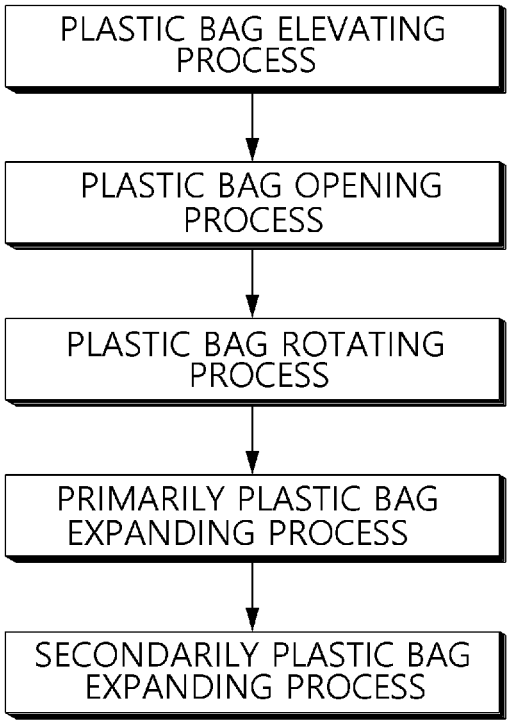
FIG. 8 is a flowchart illustrating a plastic bag opening method according to a first embodiment of the present invention.

As illustrated in FIG. 8, a plastic bag opening method according to a first embodiment of present invention includes an elevating process, an opening process, a rotating process, a primarily expanding process, and a secondarily expanding process in order that an inlet 11 of a plastic bag 10 having a pocket shape is opened to be widened.

The plastic bag opening method according to the first embodiment of present invention uses the plastic bag opening device according to the first embodiment of the present invention described above, and the plastic bag opening device 1 according to the first embodiment of the present invention includes an elevating member 100, an air blower 200, a rotating member 400, a finger member 300, and a movable member 500.

Elevating Process

Referring to FIG. 2, in the elevating process, the elevating member 100 is used to adhere a first surface 12 (a top surface in FIG. 1) of a plastic bag 10 stacked at an uppermost side of stacked plastic bags 10 and then to lift the plastic bag 10.

That is, the elevating member 100 adheres the first surface 12 of the plastic bag 10 through an adherence pad 110 and lifts the plastic bag 10 through an elevating part 120. Here, the elevating member 100 lifts the plastic bag 10 up to a horizontal line (O) at which the air blower 200 is disposed.

Here, the first surface 12 (the top surface in FIG. 1) and the second surface 13 (a bottom surface in FIG. 1), which are disposed at a side of an inlet 11 of the plastic bag 10, may have an entirely close contact state or a partially close contact state by adhesion or static electricity.

Opening Process

Referring to FIG. 3, in the opening process, the air blower 200 is used to inject air toward the inlet 11 of the plastic bag 10 adhered to the elevating member 100. Then, the inlet 11 may be opened by pressure of the air injected from the air blower 200. In particular, even when the first surface 12 and the second surface 13 that are disposed at the side of the inlet 11 of the plastic bag 10 are in close contact with each other, the first surface 12 and the second surface 13 may be easily separated from each other by the air pressure, and as a result, the inlet 11 of the plastic bag 10 may be opened to be widened.

Furthermore, part of the air having flowed into the plastic bag 10 may be discharged to the outside through the inlet 11 of the plastic bag 10, and the inlet 11 of the plastic bag 10 may be completely opened by the air discharged to the outside of the plastic bag 10.

In the opening process, the air blower 200 may inject the air toward the inlet 11 of the plastic bag 10 so that the air is injected downward at a set angle $\alpha$ with respect to the horizontal line. That is, the air blower 200 may inject the air toward the second surface 13 disposed at the side of the inlet 11 of the plastic bag 10 and accordingly, the second surface 13 of the plastic bag 10 may be easily separated from the first surface 12 of the plastic bag 10. As a result, the inlet 11 may be effectively opened.

The set angle α may be set to 3° to 10°, and preferably, may be set to 5° to 7°.

When the inlet 11 of the plastic bag 10 is opened, the rotating process, the primarily expanding process, and the secondarily expanding process may be performed for expanding an area in an inlet 11 direction of the plastic bag 10 in order to easily accommodate articles.

Rotating Process

Referring to FIG. 4, the rotating process is intended to dispose the inlet 11 of the plastic bag 10 to face upward, and when the opening process is completed, the rotating member 400 is used to rotate the elevating member 100 so that the inlet 11 of the plastic bag 10 adhered to the elevating member 100 is disposed to face upward.

Primarily Expanding Process

Referring to FIG. 6, the primarily expanding process is intended to primarily expand the inlet 11 of the plastic bag 10 and prevent the inlet 11 from sagging, and when the rotating process is completed, a pair of fingers 310 provided in the finger member 300 are inserted into the inlet 11 of the plastic bag 10 adhered to the elevating member 100, and the pair of fingers 310 are moved in directions that are away from each other. Then, the inlet 11 of the plastic bag 10 may be pulled by the pair of fingers 310 in two opposite directions to primarily expand the inlet 11 of the plastic bag 10.

Secondarily Expanding Process

Referring to FIG. 7, in the secondarily expanding process, the movable member 500 is used to move the elevating member 100 to be far away from the finger member 300 when the primarily expanding process is completed. Then, the first surface 12 of the plastic bag 10 moves together with the elevating member 100, and as a result, the inlet 11 of the plastic bag 10 may be secondarily expanded by an area (or a distance) between the finger member 300 and the elevating member 100.

When the processes as described above are completed, the articles may be conveniently inserted into the inlet 11 of the plastic bag 10 and packed.

Hereinafter, another embodiment of the present invention will be described using the same reference symbol for the same element as the embodiment described above, and duplicate description will be omitted.

[Plastic Bag Opening Device According to Second Embodiment of Present Invention]

Figure 9:
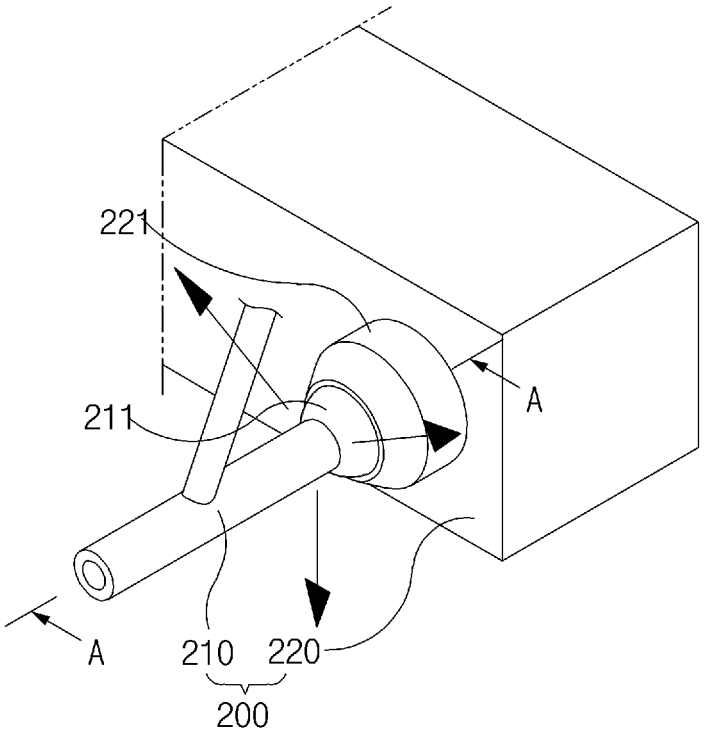
FIG. 9 is a perspective illustrating a plastic bag opening device according to a second embodiment of the present invention.
Figure 10:
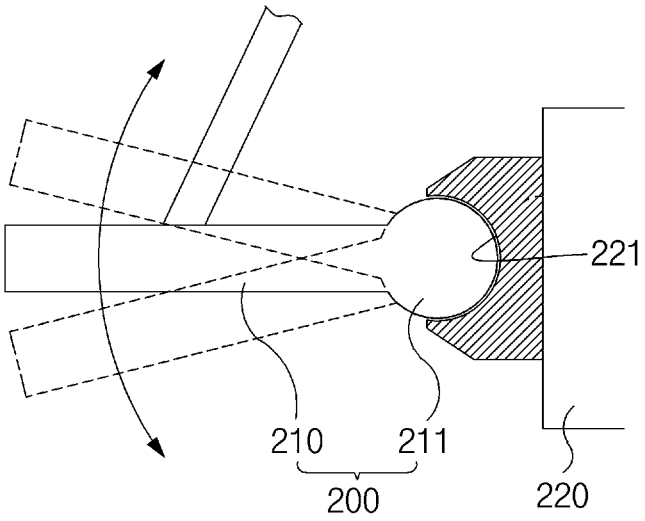
FIG. 10 is a cross-sectional view taken along a line A-A in FIG. 9.

As illustrated in FIGS. 9 and 10, a plastic bag opening device 1 according to a second embodiment of present invention includes an elevating member 100 and an air blower 200. The air blower 200 includes an injection nozzle 210, which injects air toward an inlet 11 of a plastic bag 10 so that the inlet 11 of the plastic bag 10 is opened to be widened, and a frame 220 to which the injection nozzle 210 is coupled.

Here, the injection nozzle 210 may be coupled to the frame 220 so that an angle is adjustable up and down or left and right.

In one example, referring to FIG. 10, a spherical coupling part 211 is formed in the injection nozzle 210, and a spherical coupling groove 221 to which the spherical coupling part 211 is coupled is formed in the frame 220. That is, the spherical coupling part 211 may rotate up and down or left and right within the spherical coupling groove 221, and the injection nozzle 210 may operate with the spherical coupling part 211 to adjust the angle up and down or left and right.

Thus, in the plastic bag opening device according to the second embodiment of present invention, the angle of the injection nozzle 210 may be adjusted up and down or left and right to match the inlet 11 of the plastic bag 10 adhered to the elevating member 100. As a result, the air injected from the injection nozzle 210 may be accurately injected into the inlet 11 of the plastic bag 10.

The scope of the present invention is defined by the appended claims rather than the foregoing description. Various modifications made within the meaning of an equivalent of the claims of the invention and within the claims are to be regarded to be in the scope of the present invention.

The invention claimed is:

1. A plastic bag opening device configured to open an inlet of a plastic bag having a pocket shape, the plastic bag opening device comprising:

a lifter configured to lift the plastic bag in a state in which a first surface of the plastic bag is adhered to the lifter;

an air blower configured to inject air toward the inlet of the plastic bag adhered to the lifter so that the inlet of the plastic bag is opened;

a pair of fingers configured to be inserted into the inlet of the plastic bag adhered to the lifter to pull and expand the inlet of the plastic bag in opposite directions; and a movable member configured to move the lifter away from the pair of fingers such that the inlet of the plastic bag is expanded between the pair of fingers and the lifter.

2. The plastic bag opening device of claim 1, wherein the lifter comprises:

an adherence pad configured to adhere to the first surface of the plastic bag; and an elevating part configured to cause the adherence pad to ascend so as to lift the plastic bag adhered to the adherence pad up to an imaginary horizontal line at which the air blower is disposed.

3. The plastic bag opening device of claim 2, wherein the air blower comprises:

an injection nozzle configured to inject the air toward the inlet of the plastic bag so that the inlet of the plastic bag is opened, the injection nozzle having an air injection opening configured to be inclined downward at a set angle with respect to the imaginary horizontal line; and a frame to which the injection nozzle is coupled.

4. The plastic bag opening device of claim 3, wherein the set angle is set to 3° to 10°.

5. The plastic bag opening device of claim 2, wherein the air blower comprises:

a frame; and an injection nozzle configured to inject the air toward the inlet of the plastic bag so that the inlet of the plastic bag is opened, the injection nozzle being coupled to the frame so that an angle of the injection nozzle with respect to the frame is adjustable up and down or left and right.

6. The plastic bag opening device of claim 1, further comprising a rotator configured to rotate the lifter so that the inlet of the plastic bag adhered to the lifter faces upward.

7. A plastic bag opening method that opens an inlet of a plastic bag having a pocket shape, the plastic bag opening method comprising:

an elevating process of adhering a first surface of the plastic bag to a lifter and then lifting the plastic bag using the lifter;

an opening process of opening the inlet of the plastic bag using an air blower to inject air toward the inlet of the plastic bag adhered to the lifter so that the air injected from the air blower flows into the plastic bag through the inlet;

after the rotating process, a primary expanding process of pulling and expanding the inlet of the plastic bag in opposite directions by inserting a pair of fingers into the inlet of the plastic bag adhered to the lifter and moving the pair of fingers in directions that are away from each other; and after the primary expanding process, a secondary expanding process of expanding the inlet of the plastic bag between the pair of fingers and the lifter using a movable member to move the lifter away from the pair of fingers.

8. The plastic bag opening method of claim 7, wherein, in the elevating process, the lifter lifts the plastic bag up to an imaginary horizontal line at which the air blower is disposed, and wherein, in the opening process, the air blower injects the air toward the inlet of the plastic bag so that the air is injected downward at a set angle with respect to the imaginary horizontal line.

9. The plastic bag opening method of claim 8, wherein the set angle is set to 3° to 10°.

10. The plastic bag opening method of claim 7, further comprising, after the opening process, a rotating process of rotating the lifter using a rotator so that the inlet of the plastic bag adhered to the lifter is disposed to face upward.

* * * * *